US011217140B2

(12) United States Patent
Zhang et al.

(10) Patent No.: US 11,217,140 B2
(45) Date of Patent: Jan. 4, 2022

(54) DISPLAY DRIVER CIRCUIT

(71) Applicant: SHENZHEN CHINA STAR OPTOELECTRONICS SEMICONDUCTOR DISPLAY TECHNOLOGY CO., LTD., Shenzhen (CN)

(72) Inventors: Liuqi Zhang, Shenzhen (CN); Baixiang Han, Shenzhen (CN)

( * ) Notice: Subject to any disclaimer, the term of this patent is extended or adjusted under 35 U.S.C. 154(b) by 166 days.

(21) Appl. No.: 16/619,948

(22) PCT Filed: Nov. 11, 2019

(86) PCT No.: PCT/CN2019/117164

§ 371 (c)(1),
(2) Date: Dec. 6, 2019

(87) PCT Pub. No.: WO2021/042524

PCT Pub. Date: Mar. 11, 2021

(65) Prior Publication Data

US 2021/0287581 A1 Sep. 16, 2021

(30) Foreign Application Priority Data

Sep. 3, 2019 (CN) ..... 201910828422.0

(51) Int. Cl.
*G09G 3/20* (2006.01)

(52) U.S. Cl.
CPC ..... *G09G 3/20* (2013.01); *G09G 2300/08* (2013.01); *G09G 2310/0267* (2013.01); *G09G 2310/08* (2013.01)

(58) Field of Classification Search
None
See application file for complete search history.

(56) References Cited

U.S. PATENT DOCUMENTS

2017/0018245 A1 1/2017 Park
2021/0158761 A1* 5/2021 Zhang ..... G09G 3/3266

FOREIGN PATENT DOCUMENTS

CN 109935192 A 6/2019
CN 110007628 A 7/2019

* cited by examiner

*Primary Examiner* — Ifedayo B Iluyomade
(74) *Attorney, Agent, or Firm* — JMB Davis Ben-David

(57) ABSTRACT

The present invention provides a method of driving a display panel and a driving device. The present invention determines sub-pixels shared by sub-pixel rendering technology through comparing differences of the color components, and the sub-pixels shared by the display image are not fixed. Since the sub-pixels with the smallest absolute value of the color component difference are selected for sharing, a contrast of an edge region of an image is improved, and distortion of an edge region of an image is reduced.

19 Claims, 3 Drawing Sheets

DISPLAY DRIVER CIRCUIT

CROSS-REFERENCE TO RELATED APPLICATIONS

This is the U.S. National Stage of International Patent Application No. PCT/CN2019/117164, filed Nov. 11, 2019, which in turn claims the benefit of Chinese Patent Application No. 201910828422.0, filed Sep. 3, 2019.

BACKGROUND OF INVENTION

Field of Invention

The present application relates to the field of display technologies, and in particular, to a display driving circuit.

Description of Prior Art

In the field of display panels, at present, mainstream displays are divided into two types, namely liquid crystal displays and organic electroluminescent diode displays. Although imaging principles of a liquid crystal display and an organic electroluminescent diode display are different, both of them include pixel units arranged in an array. In order to realize a display function of a display, it is necessary to provide a scanning-signal to the pixel units row by row to drive the pixel units to work. The currently developed gate driver on array (GOA) technology, that is, the array substrate row driving technology, directly scans a driving circuit on an array substrate, thereby saving a space for separately setting the scanning driving circuit through an integrated chip, which is advantageous for realizing a narrow bezel design of the display, and reducing a soldering process of the integrated chip. Therefore, applications of GOA technology in the field of display panels are becoming more and more extensive.

On a basis of the GOA technology, in order to achieve stable display of the display panel and improve a stability of signals input to the array substrate, a compensation circuit is introduced. An operation of the compensation circuit needs to be completed by a combination of a positive pulse signal and a negative pulse signal. In the prior art, the positive pulse signal and the negative pulse signal are respectively supplied to a compensation circuit by a driving circuit including an n-type transistor and a driving circuit including a p-type transistor.

SUMMARY OF INVENTION

In the prior art, the display driving circuit for providing the positive pulse signal and the negative pulse signal to the compensation circuit needs to include both the n-type transistor and the p-type transistor, and in the manufacturing of the array substrate, it is difficult to simultaneously fabricate the driving circuit including the n-type transistor and the driving circuit including the p-type transistor, which involves a complicated process with a low production efficiency.

In order to solve the above technical problems, the present application provides a solution as follows:

The present application provides a display driving circuit including driving units of a plurality of stages, and each of the driving units includes:

a pull-up maintaining unit electrically connected to a first clock signal input terminal, a first cascade signal input terminal, a first node, and a second node, and configured to transmit a signal input from the first cascade signal input terminal to the first node and the second node under control of a signal input from the first clock signal input terminal;

a pull-up unit electrically connected to a second clock signal input terminal, the first node, the third node, and the fourth node, and configured to transmit a signal input from the second clock signal input terminal to the third node and the fourth node under control of a signal of the first node;

an output pull-down unit electrically connected to a third low-voltage signal input terminal, the first node and the fifth node, and configured to transmit the signal input from the third low-voltage signal input terminal to the fifth node under control of the signal of the first node;

a feedback unit electrically connected to the third node, the fourth node, and the second node, and configured to electrically communicate the second node and the fourth node under control of a signal of the third node.

a pull-down unit electrically connected to a second cascade signal input terminal, the first node, the third node, a sixth node, a seventh node, and an eighth node, and configured to transmit signals of the sixth node and the seventh node to the eighth node, the first node, and the third node under control of a signal input from the second cascade signal input terminal;

a pull-down maintaining unit electrically connected to a first high-voltage signal input terminal, the first node, the third node, the fourth node, the fifth node, the sixth node, the seventh node, the eighth node, and the ninth node, and configured to transmit a signal input from the first high-voltage signal input terminal to the fifth node, transmit a signal of the seventh node to the third node and the fourth node, and transmit a signal of the sixth node to the eighth node and the first node, under control of a signal of the ninth node;

an inverter unit electrically connected to a second high-voltage signal input terminal, the first node, the sixth node, and the ninth node, and configured to adjust the signal of the ninth node by a signal input from the second high-voltage signal input terminal and the signal of the sixth node, under control of the signal of the first node;

wherein, the fifth node is electrically connected to a scanning-signal output terminal, the third node is electrically connected to a cascade signal output terminal, the sixth node is electrically connected to a first low-voltage signal input terminal, and the seventh node is electrically connected a second low-voltage signal input terminal.

In the display driving circuit of the present application, the pull-up maintaining unit comprises a first transistor and a second transistor.

In the display driving circuit of the present application, a gate of the first transistor and a gate of the second transistor are electrically connected to the first clock signal input terminal, a source of the first transistor is electrically connected to the first cascade signal input terminal, a drain of the second transistor is electrically connected to the first node, and a drain of the first transistor and a source of the second transistor are both electrically connected to the second node.

In the display driving circuit of the present application, the pull-up unit comprises a third transistor and a fourth transistor.

In the display driving circuit of the present application, a gate of the third transistor and a gate of the fourth transistor are electrically connected to the first node, a source of the third transistor and a source of the fourth transistor are electrically connected to the second clock signal input terminal, a drain of the third transistor is electrically connected to the third node, and a drain of the fourth transistor is electrically connected the fourth node.

In the display driving circuit of the present application, the output pull-down unit comprises a fifth transistor.

In the display driving circuit of the present application, a gate of the fifth transistor is electrically connected to the first node, a source is electrically connected to the third low-voltage signal input terminal, and a drain is electrically connected the fifth node.

In the display driving circuit of the present application, the feedback unit comprises a sixth transistor.

In the display driving circuit of the present application, a gate of the sixth transistor is electrically connected to the third node, a source of the sixth transistor is electrically connected to the fourth node, and a drain of the sixth transistor is electrically connected to the second node.

In the display driving circuit of the present application, the pull-down unit comprises a seventh transistor, an eighth transistor, and a ninth transistor.

In the display driving circuit of the present application, a gate of the seventh transistor, a gate of the eighth transistor, and a gate of the ninth transistor are electrically connected to the second cascade signal input terminal, a source of the seventh transistor is electrically connected to the seventh node, a drain of the seventh transistor is electrically connected to the third node, a source of the eighth transistor and a drain of the seventh transistor are electrically connected to the eighth node, a drain of the eighth transistor is electrically connected to the first node, and a source of the ninth transistor is electrically connected to the sixth node.

In the display driving circuit of the present application, the pull-down maintaining unit comprises a tenth transistor, an eleventh transistor, a twelfth transistor, a thirteenth transistor, and a fourteenth transistor.

In the display driving circuit of the present application, a gate of the tenth transistor, a gate of the eleventh transistor, a gate of the twelfth transistor, a gate of the thirteenth transistor, and a gate of the fourteenth transistor are electrically connected to the ninth node, and a drain of the tenth transistor and a source of the eleventh transistor are electrically connected to the eighth node, a source of the tenth transistor is electrically connected to the sixth node, a drain of the eleventh transistor is electrically connected to the first node, a source of the twelfth transistor and a source of the thirteenth transistors are electrically connected to the seventh node, a drain of the twelfth transistor is electrically connected to the fourth node, and a drain of the thirteenth transistor is electrically connected to the third node, a source of the fourteenth transistor is electrically connected to the first high-voltage signal input terminal, and a drain of the fourteenth transistor is electrically connected to the fifth node.

In the display driving circuit of the present application, the inverter unit comprises a fifteenth transistor, a sixteenth transistor, a seventeenth transistor, and an eighteenth transistor.

In the display driving circuit of the present application, a gate of the fifteenth transistor and a gate of the seventeenth transistor are electrically connected to the first node, a source of the fifteenth transistor and a source of the seventeenth transistor are electrically connected to the sixth node, a drain of the fifteenth transistor and a drain of the sixteenth transistor are electrically connected to the ninth node, a source of the sixteenth transistor, a source of the eighteenth transistor, and a gate of the eighteenth transistor gate are electrically connected to the second high-voltage signal input terminal, and a gate of the sixteenth transistor and a drain of the seventeenth transistor are electrically connected to a drain of the eighteenth transistor.

In the display driving circuit of the present application, the first low-voltage signal input terminal, the second low-voltage signal input terminal, and the third low-voltage signal input terminal continuously input low-voltage signals, and the first high-voltage signal input terminal and the second high-voltage signal input terminal continuously input high-voltage signals.

In the display driving circuit of the present application, the first cascade signal input terminal of the driving unit of a first stage is electrically connected to a start signal line, and the start signal line is configured to send a start signal to the first cascade signal input terminal; and the second cascade signal input terminal of the driving unit of the first stage is electrically connected to the cascade signal output terminal of the driving unit of a second stage.

In the display driving circuit of the present application, the first cascade signal input terminal of the driving unit of a nth stage is electrically connected to cascade signal output terminal of the driving unit of a n−1th stage; and the second cascade signal input terminal of the driving unit of a nth stage is electrically connected to the cascade signal output terminal of the driving unit of a n+1th stage, wherein n is an integer greater than or equal to 2.

In the display driving circuit of the present application, the second cascade signal input terminal of the driving unit of a last stage is electrically connected to the first low-voltage signal input of the driving unit of a last stage.

In the display driving circuit of the present application, the first clock signal input terminal of the driving unit of a 2i−1th stage is electrically connected to the second clock signal line, and the second clock signal input terminal of the driving unit of the 2i−1th stage is electrically connected to the first clock signal line; and the first clock signal input terminal of the driving unit of a 2ith stage is electrically connected to the first clock signal line, and the second clock signal input terminal of the driving unit of the 2i−1th stage is electrically connected to the 2ith stage is electrically connected to the second clock signal line, wherein i is an integer greater than or equal to 1.

The display driving circuit provided by the present application can simultaneously output a positive pulse signal and a negative pulse signal, and the display driving circuit is composed of n-type transistors, and therefore can be completed by a same process in the manufacturing of the display driving circuit. Compared with the prior art, which adopts the design that the driving signals are provided by the positive pulse driving circuit and the negative pulse driving circuit respectively, the present application directly outputs the positive and negative pulse signals through one display driving circuit, which simplifies the circuit structure and improves the manufacturing efficiency.

BRIEF DESCRIPTION OF DRAWINGS

In order to more clearly illustrate the embodiments or the technical solutions of the existing art, the drawings illustrating the embodiments or the existing art will be briefly described below. Obviously, the drawings in the following description merely illustrate some embodiments of the present invention. Other drawings may also be obtained by those skilled in the art according to these figures without paying creative work.

DETAILED DESCRIPTION OF PREFERRED EMBODIMENTS

The following description of the various embodiments is provided to illustrate the specific embodiments of the invention. The spatially relative directional terms mentioned in the present invention, such as "upper", "lower", "before", "after", "left", "right", "inside", "outside", "side", etc. and the like, may be used herein for ease of description to describe one element or feature's relationship to another element(s) or feature(s) as illustrated in the figures which are merely references. The spatially relative terms are intended to encompass different orientations in addition to the orientation as depicted in the figures.

The display driving circuit provided by an embodiment of the present application can simultaneously output a positive pulse signal and a negative pulse signal, and the display driving circuit is composed of n-type transistors, and therefore can be completed by a same process in the process of manufacturing the display driving circuit. Compared with the prior art, which adopts the design that the driving signals are provided by the positive pulse driving circuit and the negative pulse driving circuit respectively, the present application directly outputs the positive and negative pulse signals through one display driving circuit, which simplifies the circuit structure and improves the manufacturing efficiency.

The display driving circuit provided by an embodiment of the present application includes driving units of a plurality of stages having a cascading relationship, and the driving unit of each of the stages is electrically connected to the driving units of the superior and subordinate stages through a cascade signal line. It should be noted that the driving unit of each stage is identical in structure. The structure of the driving unit of the display driving circuit and the cascading relationship between the driving units of the stages provided by embodiments of the present application will be described below with reference to the accompanying drawings.

Figure 1:
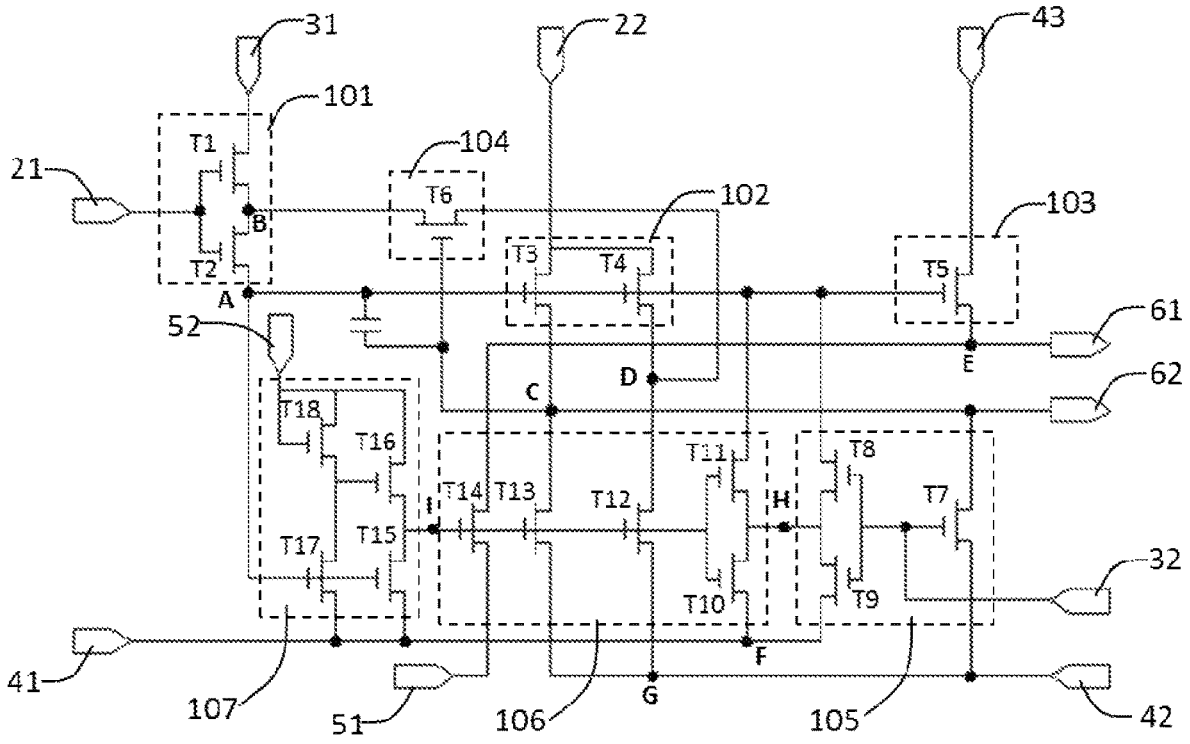
FIG. 1 is a schematic structural diagram of a driving unit of single-stage according to an embodiment of the present application.

FIG. 1 is a schematic structural diagram of a driving unit provided by an embodiment of the present application. The driving unit includes a pull-up maintaining unit 101, a pull-up unit 102, an output pull-down unit 103, a feedback unit 104, a pull-down unit 105, a pull-down maintaining unit 106, and an inverter unit 107.

The pull-up maintaining unit 101 is electrically connected to a first clock signal input terminal 21, a first cascade signal input terminal 31, a first node A, and a second node B, respectively. The pull-up maintaining unit 101 may transmit a signal input from the first cascade signal input terminal 31 to the first node A and the second node B under control of a signal input from the first clock signal input terminal 21.

It should be noted that the first clock signal input terminal 21 is electrically connected to an external clock signal line, and the clock signal line inputs a clock signal to the pull-up maintaining unit 101 through the first clock signal input terminal 21.

Specifically, the pull-up maintaining unit 101 includes a first transistor T1 and a second transistor T2, and the first transistor T1 and the second transistor T2 are n-type transistors.

It should be noted that, for an n-type transistor, when a gate of the n-type transistor is at a high-level, a source and a drain of the transistor are turned on, and the transistor is turned on; while when the gate of the transistor is at a low-level, the source and the drain of the transistor are turned off, and the transistor is turned off. The n-type transistor described in an embodiment of the present application is a symmetrical transistor, that is, the source and the drain of the transistor are interchangeable.

Specifically, a gate of the first transistor T1 and a gate of the second transistor T2 are electrically connected to the first clock signal input terminal 21, a source of the first transistor T1 is electrically connected to the first cascade signal input terminal 31, a drain of the second transistor T2 is electrically connected to the first node A, and the drain of the first transistor T1 and the source of the second transistor T2 are electrically connected to the second node B.

The pull-up unit 102 is electrically connected to the second clock signal input terminal 22, the first node A, the third node C, and the fourth node D, respectively. The pull-up unit 102 can transmit a signal input from the second clock signal input terminal 22 to the third node C and the fourth node D under control of a signal of the first node A.

It should be noted that the second clock signal input terminal 22 is electrically connected to the external clock signal line, and the clock signal line inputs a clock signal to the pull-up unit 102 through the second clock signal input terminal 22.

Specifically, the pull-up unit 102 includes a third transistor T3 and a fourth transistor T4, and the third transistor T3 and the fourth transistor T4 are n-type transistors.

Specifically, a gate of the third transistor T3 and a gate of the fourth transistor T4 are electrically connected to the first node A, a source of the third transistor T3, and a source of the fourth transistor T4 are electrically connected to the second clock signal input terminal 22, a drain of the third transistor T3 is electrically connected to the third node C, and a drain of the fourth transistor T4 is electrically connected to the fourth node D.

The output pull-down unit 103 is electrically connected to a third low-voltage signal input terminal 43, the first node A and a fifth node E, respectively. The output pull-down unit 103 can transmit a signal input from the third low-voltage signal input terminal 43 to the fifth node E under control of the signal of the first node A.

It should be noted that the third low-voltage signal input terminal 43 is connected to an external low-voltage signal line, and the low-voltage signal line provides a low-voltage signal to the output pull-down unit 103 through the third low-voltage signal input terminal 43. Specifically, the third low-voltage signal input 43 continuously input low-voltage signals to the output pull down unit 103. It should be understood that the negative pulse signal output by the display driving circuit described in this embodiment is derived from a negative voltage signal input from the low-voltage signal input terminal 43.

Specifically, the output pull-down unit 103 includes a fifth transistor T5, which is an n-type transistor.

Specifically, a gate of the fifth transistor T5 is electrically connected to the first node A, and a source of the fifth transistor T5 is electrically connected to the third low-voltage signal input terminal 43. A drain of the fifth transistor T5 is electrically connected to the fifth node E. It should be understood that the negative voltage signals provided by the low-voltage signal input terminal 43 are intermittently transmitted to the fifth node E under control of the fifth transistor T5 to form the negative pulse signals.

The feedback unit 104 is electrically connected to the third node C, the fourth node D, and the second node B, respectively. The feedback unit 104 is configured to electrically connect the second node B and the fourth node D under control of a signal of the third node C. Specifically, the feedback unit 104 is configured to feed back a voltage of the fifth node D to the second node B under control of a voltage signal of the third node C to update a potential of the second node B.

Specifically, the feedback unit 104 includes a sixth transistor T6, which is an n-type transistor. A gate of the sixth transistor T6 is electrically connected to the third node C, a source of the sixth transistor T6 is electrically connected to the fourth node D, and a drain of the sixth transistor T6 is electrically connected to the second node B.

The pull-down unit 105 is electrically connected to the second cascading signal input terminal 32, the first node A, the third node C, a sixth node F, a seventh node G, and an eighth node H, respectively. The pull-down unit 105 is configured to transmit the signals of the sixth node F and the seventh node G to the eighth node, the first node A, and the third node C under control of the signal input from the second cascade signal input terminal 32. It should be noted that the second cascade signal input terminal 32 is connected to the cascade signal output terminal of the driving unit of a next stage, to pull down output potentials of the scanning-signal output terminal of a current stage and the cascade signal output terminal.

Specifically, the pull-down unit 105 includes a seventh transistor T7, an eighth transistor T8, and a ninth transistor T9, and the seventh transistor T7, the eighth transistor T8, and the ninth transistor T9 are n-type transistors.

Specifically, a gate of the seventh transistor T7, a gate of the eighth transistor T8, and a gate of the ninth T9 transistor are electrically connected to the second cascade signal input terminal 32, a source of the seventh transistor T7 is electrically connected to the seventh node G, a drain of the seventh transistor T7 is electrically connected to the third node C, a source of the eighth transistor T8 and a drain of the ninth transistor T9 are electrically connected to the eighth node H, a drain of the eighth transistor T8 is electrically connected to the first node A, and a source of the ninth transistor T9 is electrically connected to the sixth node F. It should be understood that when the second cascade signal input terminal 32 inputs a high-level signal, the seventh transistor T7 is turned on to transmit a potential of the seventh node G to the third node C, and the eighth transistor T8 and the ninth transistor T9 are turned on to transmit a potential of the sixth node F to the first node A.

The pull-down maintaining unit 106 is electrically connected to the first high-voltage signal input terminal 51, the first node A, the third node C, the fourth node D, the fifth node E, and the sixth node F, the seventh node G, the eighth node H, and the ninth node I, respectively. The pull-down maintaining unit 106 is configured to transmit a signal input from the first high-voltage signal input terminal 51 to the fifth node E, transmit a signal of the seventh node G to the third node C and the fourth node D, and transmit a signal of the sixth node F to the eighth node H and the first node A, under control of a signal of the ninth node I.

Specifically, the pull-down maintaining unit 106 includes a tenth transistor T10, an eleventh transistor T11, a twelfth transistor T12, a thirteenth transistor T13, and a fourteenth transistor T14, and the tenth transistor T10, the eleventh transistor T11, the twelfth transistor T12, the thirteenth transistor T13, and the fourteenth transistor T14 are all n-type transistors.

Specifically, a gate of the tenth transistor T10, a gate of the eleventh transistor T11, a gate of the twelfth transistor T12, a gate of the thirteenth transistor T13, and a gate of the fourteenth transistor T14 are electrically connected to the ninth node I; a drain of the tenth transistor T10 and a source of the eleventh transistor T11 are electrically connected to the eighth node H; a source of the tenth transistor T10 is electrically connected to the sixth node F; a drain of the eleventh transistor T11 is electrically connected to the first node A; a source of the twelfth transistor T12 and a source of the thirteenth transistor T13 are electrically connected to the seventh node G; a drain of the twelfth transistor T12 is electrically connected to the fourth node D; a drain of the thirteenth transistor T13 is electrically Connected to the third node C; a source of the fourteenth transistor T14 is electrically connected to the first high-voltage signal input terminal 51; and a drain of the fourteen transistor T14 is electrically connected to the fifth node E.

The inverter unit 107 is electrically connected to the second high-voltage signal input terminal 52, the first node A, the sixth node F, and the ninth node I, respectively, and configured to adjust the signal of the ninth node I by a signal input from the second high-voltage signal input terminal 52 and the signal of the sixth node F, under control of the signal of the first node A.

Specifically, the inverter unit 107 includes a fifteenth transistor T15, a sixteenth transistor T16, a seventeenth transistor T17, and an eighteenth transistor T18; and the fifteenth transistor T15, the sixteenth transistor T16, the seventeenth transistor T17, and the eighteenth transistor T18 are all n-type transistors.

Specifically, a gate of the fifteenth transistor T15 and a gate of the seventeenth transistor T17 are electrically connected to the first node A; a source of the fifteenth transistor T15, and a source of the seventeenth transistor T17 are electrically connected to the sixth node F; a drain of the fifteenth transistor T15 and a drain of the sixteenth transistor T16 are electrically connected to the ninth node I; a source of the sixteenth transistor T16, a source of the eighteenth transistor T18, and a gate of the eighteenth transistor T18 are all electrically connected to the second high-voltage signal input terminal 52; and a gate of the sixteenth transistor T16 and a drain of the seventeenth transistor T17 are electrically connected to a drain of the eighteenth transistor T18. Specifically, the second high-voltage signal input terminal 52 is connected to an external high-voltage signal line, and the high-voltage signal line continuously inputs a high-voltage signal to the inverter unit 107 through the high-voltage signal input terminal 52. It should be understood that an operating principle of the inverter unit 107 is that when the first node A is at a high-level, the seventeenth transistor T17 and the fifteenth transistor T15 are turned on, the sixteenth transistor T16 is turned off, and a voltage signal of the sixth node F is transmitted to the ninth node I; while when the first node A is at a low-level, the seventeenth transistor T17 and the fifteenth transistor T15 are turned off, the sixteenth transistor T16 is turned on, the eighteenth transistor T18 is also turned on, and a high-voltage signal input from the second high-voltage signal input terminal 52 is transmitted to the ninth node I.

Specifically, the sixth node F is electrically connected to the first low-voltage signal input terminal 41, and the seventh node G is electrically connected to the second low-voltage signal input terminal 42. The first low-voltage signal input terminal 41 and the second low-voltage signal input terminal 42 are respectively electrically connected to the external low-voltage signal line, to continuously input a low-level signal to the sixth node F and the seventh node G.

Specifically, the fifth node E is electrically connected to the scanning-signal output terminal 61, and the third node C is electrically connected to the cascade signal output terminal 62. It should be understood that the scanning-signal output terminal 61 can intermittently output a high-voltage signal provided by the first high-voltage signal input terminal 51 and a low-voltage signal provided by the third low-voltage signal input terminal 43 to form a negative pulse signal. The cascade signal output 62 can intermittently output a clock signal input from the second clock signal input terminal 22 and a low-voltage signal supplied from the second low-voltage signal input terminal 42 to form a positive pulse signal. In addition, the cascade signal output terminal 62 is electrically connected to the first cascade signal input terminal 31 of the driving unit of a next stage, thereby transmitting a cascade signal of the driving unit of the current stage to the driving unit of the next stage, thereby implementing a linkage driving effect of the driving units of a plurality of stages.

It should be noted that the display driving circuit provided by an embodiment of the present application includes driving units of multi-staged cascades, and the driving units of the stages are identical in structure. The cascading relationship of the display driving circuit provided by an embodiment of the present application will be described below with reference to FIG. 2.

Figure 2:
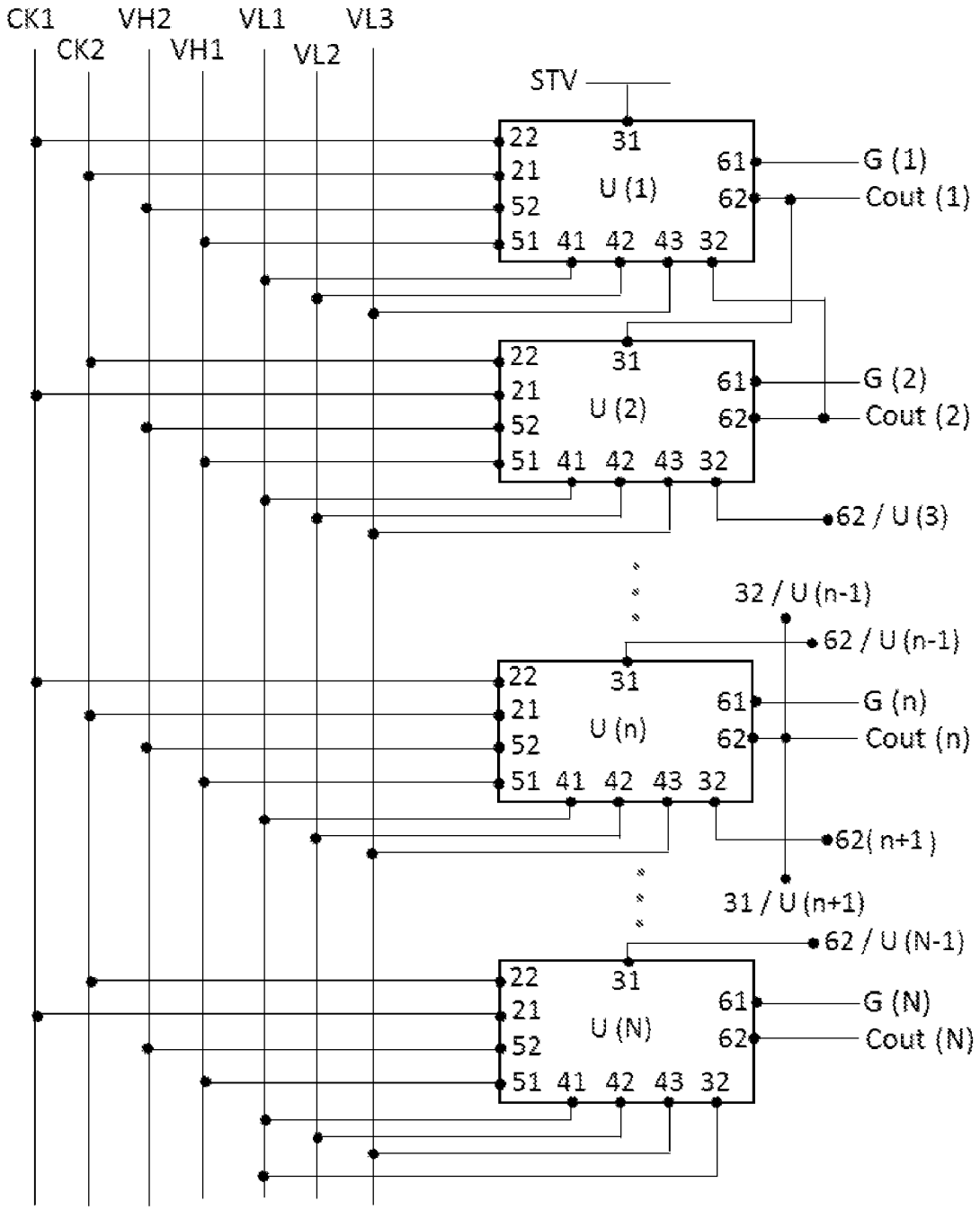
FIG. 2 is a cascading relationship diagram of a display driving circuit according to an embodiment of the present application.

As shown in FIG. 2, it is a cascading relationship diagram of a display driving circuit provided by an embodiment of the present application. The display driving circuit includes a total of N driving units, where N is a positive integer.

For the driving unit U (1) of a first stage, the first cascade signal input terminal 31 is electrically connected to a start signal line STV, and the start signal line STV is configured to transmit a start signal to the first cascade signal input terminal 31. The second cascade signal input terminal 32 is electrically connected to the cascade signal output terminal 62 of the drive unit U (2) of a second stage.

For the driving unit U(n) of an nth stage, wherein n is an integer greater than or equal to 2, the first cascade signal input terminal 31 is electrically connected to the cascade signal output terminal 62 of the driving unit U(n−1) of an n−1th stage; the second cascade signal input terminal 32 is electrically connected to the cascade signal output terminal 62 of the driving unit U (n+1) of an n+1th stage; and the cascade signal output terminal 62 is electrically connected to the second cascaded signal input terminal 32 of the drive unit U(n−1) of the n−1th stage and the first cascaded signal input terminal 31 of the drive unit U(n+1) of the n+1th stage.

For the Nth stage driving unit U (N), where N is an integer greater than or equal to 2, the second cascade signal input terminal 32 is electrically connected to the first low-voltage signal line VL1, and the first low-voltage signal line VL1 is configured to continuously input a low-voltage signal to the second cascade signal input terminal 32.

The cascading relationship between the driving units in the display driving circuit is disclosed as above, and an input/output relationship between the display driving circuit and the external signal line is disclosed as follows:

Referring to FIG. 2, the first high-voltage signal input terminal 51 and the second high-voltage signal input terminal 52 are electrically connected to the first high-voltage signal line VH1 and the second high-voltage signal line VH2, respectively. The first high-voltage signal line VH1 and the second high-voltage signal line VH2 are configured to continuously input high-voltage signals to the first high-voltage signal input terminal 51 and the second high-voltage signal input terminal 52, respectively; the first low-voltage signal input terminal 41, the second low-voltage signal input terminal 42, and the third low-voltage signal input terminal 43 are electrically connected to the first low-voltage signal line VL1, the second low-voltage signal line VL2, and the third low-voltage signal line VL3, respectively; and the first low-voltage signal line VL1, the second low-voltage signal line VL2, and the third low-voltage signal line VL3 are respectively configured to input low-voltage signals to the first low-voltage signal input terminal 41, the second low-voltage signal input terminal 42, and the third low-voltage signal input terminal 43.

The scanning-signal output terminal 61 outputs a scanning-signal G for providing a negative pulse signal to an external compensation circuit; while the cascade signal output terminal 62 outputs a cascade signal Cout for providing a positive pulse signal to the external compensation circuit.

The first clock signal input terminal 21 of the driving unit U (2i−1) of a 2i−1th stage is electrically connected to the second clock signal line CK2, and the second clock signal input terminal 22 of the driving unit it U (2i−1) of the 2i−1th stage is electrically connected to the first clock signal line CK1; the first clock signal input terminal 21 of the driving unit U (2i) of a 2ith stage is electrically connected to the first clock signal line CK1, and the second clock signal input terminal 22 of the driving unit U (2i) of a 2ith stage is electrically connected to the second clock signal line CK2, wherein i is an integer greater than or equal to 1. It should be understood that the driving unit U (2i−1) of the 2i−1 stage and the driving unit U (2i) of the 2ith stage are the driving units corresponding to any two of the driving unit U (1) of the first stage to the drive unit U (N) of the Nth stage shown in FIG. 2.

Figure 3:
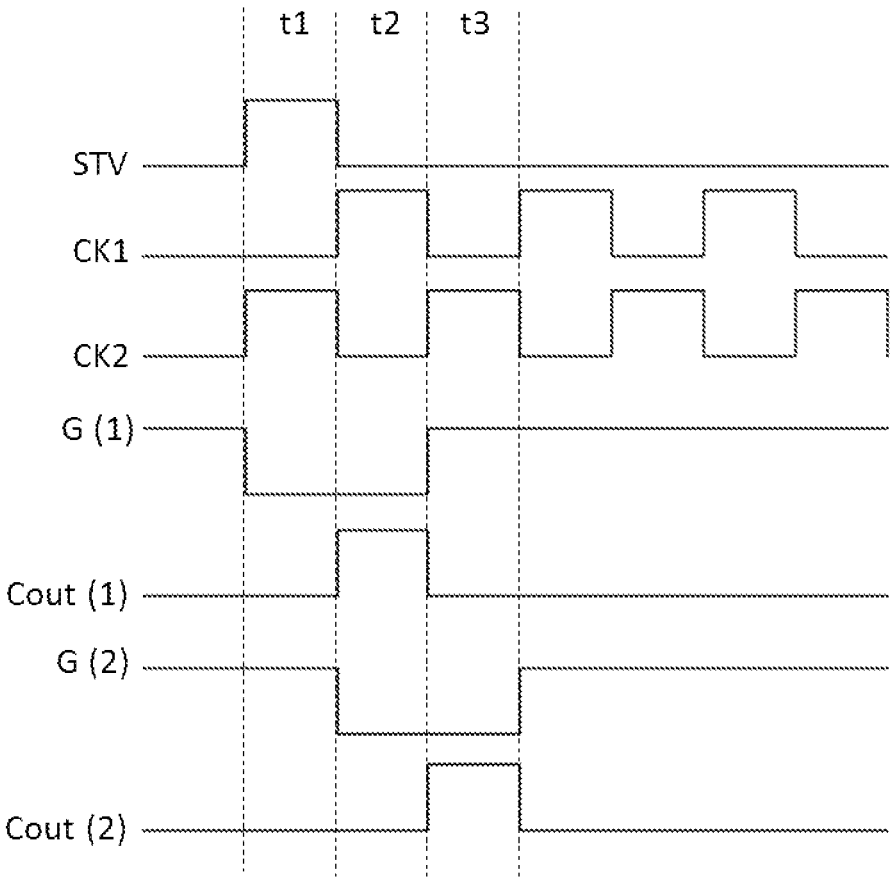
FIG. 3 is an operation sequence diagram of driving units of a first-stage and a second-stage in the display driving circuit according to an embodiment of the present application.

The operation sequence diagram of the display driving circuit provided by an embodiment of the present application is analyzed in conjunction with FIG. 1 to FIG. 3.

During a period t1, the start signal line STV and the second clock signal line CK2 are at high-levels, and the first clock signal line CK1 is at a low-level. For the driving unit U (1) of the first-stage, the first transistor T1 and the second transistor T2 are turned on, and the first node A receiving a signal of the start signal line STV is represented as high-level; the third transistor T3 and the fifth transistor T5 are turned on, and the third node C receiving a signal of the first clock signal line CK1 is represented as a low-level, and the fifth node E receiving a low-voltage signal input from the third low-voltage signal input terminal 43 is represented as a low-level. Therefore, the scanning-signal G (1) is at a low-level, and the cascaded signal Cout (1) is at a low-level.

During a period t2, the first clock signal line CK1 is at a high-level, and the start signal line STV and the second clock signal line CK2 are at a low-level. For the first stage driving unit U (1), the first transistor T1 and the second transistor T2 are turned off, and the first node A is kept at a high-level, while the third transistor T3, the fourth transistor T4 and the fifth transistor T5 are turned on, the third node C receiving a signal of the first clock signal line CK1 is represented as a high-level, and the fifth node E receiving a low-voltage input from the third low-voltage signal input terminal 43 is represented as a low-level. Therefore, the scanning-signal G (1) is at a low-level, and the cascaded signal Cout (1) is at a high-level. It should be understood that the driving unit U (2) of the second stage during the t2 period has the same input/output sequence as the driving unit U (1) of the first stage during the t1 period. Therefore, for the second-stage driving unit U (2), the scanning signal G (2) is at a low-level, and the cascade signal Cout (2) is at a low-level.

During a period of t3, the stat signal line STV and the first clock signal line CK1 are at low-levels, and the second clock signal line CK2 is at a high-level. For the first stage driving unit U (1), the first transistor T1 and the second transistor T2 are turned on, and the first node A receiving a signal of the start signal line STV is represented as a low-level; the seventeen transistor T17 and the fifteenth transistor T15 are turned off, the eighteenth transistor T18 and the sixteenth transistor T16 are turned on, and the ninth node I receiving a high-voltage signal of the second high-voltage signal line VH2 is represented as a high-level; the fourteenth transistor T14 and the thirteenth transistor T13 are turned on, the fifth node E receiving a high-voltage signal of the first high-voltage signal line VH1 is represented as high-level, and the third node C receiving a low-voltage signal of the second low-voltage signal line VL2 is represented as a low-level. Therefore, the scanning-signal G (1) is at a high-level, while the cascade signal Cout (1) is at a low-level. Similarly, for the driving unit U (2) of the second-stage, the scanning-signal G (2) is at a low-level, while the cascade signal Cout (2) is at a high-level.

It should be understood that the time difference between the output pulse signals (the scanning-signal G and the cascade signal Cout) of the driving units of adjacent two stages is one-half of the clock signal period. Through the above analysis of the input/output sequences of the first-stage driving unit and the second-stage driving unit, the input/output sequences of the remaining driving units can be readily deduced, and details are not repeated herein for brevity. It should be noted that the display driving circuit in an embodiment of the present application sequentially outputs the scanning-signal G and the cascade signal Cout through the driving unit of each stage, wherein the scanning-signal G is a negative pulse signal, and the cascade signal Cout is a positive pulse signal, thereby complying with the operation requirements of the external compensation circuit.

In summary, the display driving circuit provided by an embodiment of the present application can simultaneously output a positive pulse signal and a negative pulse signal, and the display driving circuit is composed of n-type transistors, thereby obviating the necessity of using an n-type transistor together with a p-type transistor in the prior art when the positive pulse signal and the negative pulse signal are provided by a positive pulse driving circuit and a negative pulse driving circuit respectively, which causes a complicated process and a complicated circuit.

While the invention has been described by way of example and in terms of the preferred embodiments, it is to be understood that the invention is not limited to the disclosed embodiments. To the contrary, it is intended to cover various modifications and similar arrangements. Therefore, the scope of the appended claims should be accorded the broadest interpretation so as to encompass all such modifications and similar arrangements.

What is claimed is:

1. A display driving circuit, comprising a multi-level driving unit, the driving unit comprising:

a pull-up maintaining unit electrically connected to a first clock signal input terminal, a first cascade signal input terminal, a first node, and a second node, and configured to transmit a signal input by the first cascade signal input terminal to the first node and the second node under control of a signal input by the first clock signal input terminal;

a pull-up unit electrically connected to a second clock signal input terminal, the first node, the third node, and the fourth node, and configured to transmit a signal input by the second clock signal input terminal to the third node and the fourth node under control of a signal of the first node;

an output pull-down unit electrically connected to a third low-voltage signal input terminal, the first node and the fifth node, and configured to transmit the signal input by the third low-voltage signal input terminal to the fifth node under control of the signal of the first node;

a feedback unit electrically connected to the third node, the fourth node, and the second node, and configured to electrically communicate the second node and the fourth node under control of a signal of the third node;

a pull-down unit electrically connected to a second cascade signal input terminal, the first node, the third node, a sixth node, a seventh node, and an eighth node, and configured to transmit signals of the sixth node and the seventh node to the eighth node, the first node, and the third node under control of a signal input by the second cascade signal input terminal;

a pull-down maintaining unit electrically connected to a first high-voltage signal input terminal, the first node, the third node, the fourth node, the fifth node, the sixth node, the seventh node, the eighth node, and the ninth node, and configured to transmit a signal input by the first high-voltage signal input terminal to the fifth node, transmit a signal of the seventh node to the third node and the fourth node, and transmit a signal of the sixth node to the eighth node and the first node, under control of a signal of the ninth node;

an inverter unit electrically connected to a second high-voltage signal input terminal, the first node, the sixth node, and the ninth node, and configured to adjust the signal of the ninth node by a signal input by the second high-voltage signal input terminal and the signal of the sixth node, under control of the signal of the first node;

wherein, the fifth node is electrically connected to a scanning-signal output terminal, the third node is electrically connected to a cascade signal output terminal, the sixth node is electrically connected to a first low-voltage signal input terminal, and the seventh node is electrically connected a second low-voltage signal input terminal; and wherein the first clock signal input terminal of the driving unit of a 2i−1th stage is electrically connected to the second clock signal line, and the second clock signal input terminal of the driving unit of the 2i−1th stage is electrically connected to the first clock signal line; and the first clock signal input terminal of the driving unit of a 2ith stage is electrically connected to the first clock signal line, and the second clock signal input terminal of the driving unit of the 2i−1th stage is electrically connected to the 2ith stage is electrically connected to the first clock signal line, wherein i is an integer greater than or equal to 1.

2. The display driving circuit according to claim 1, wherein the pull-up maintaining unit comprises a first transistor and a second transistor.

3. The display driving circuit according to claim 2, wherein a gate of the first transistor and a gate of the second transistor are electrically connected to the first clock signal input terminal, a source of the first transistor is electrically connected to the first cascade signal input terminal, a drain of the second transistor is electrically connected to the first node, and a drain of the first transistor and a source of the second transistor are both electrically connected to the second node.

4. The display driving circuit according to claim 1, wherein the pull-up unit comprises a third transistor and a fourth transistor.

5. The display driving circuit according to claim 4, wherein a gate of the third transistor and a gate of the fourth transistor are electrically connected to the first node, a source of the third transistor and a source of the fourth transistor are electrically connected to the second clock signal input terminal, a drain of the third transistor is electrically connected to the third node, and a drain of the fourth transistor is electrically connected the fourth node.

6. The display driving circuit of claim 1, wherein the output pull-down unit comprises a fifth transistor.

7. The display driving circuit of claim 6, wherein a gate of the fifth transistor is electrically connected to the first node, a source is electrically connected to the third low-voltage signal input terminal, and a drain is electrically connected the fifth node.

8. The display driving circuit of claim 1, wherein the feedback unit comprises a sixth transistor.

9. The display driving circuit as claimed in claim 8, wherein a gate of the sixth transistor is electrically connected to the third node, a source of the sixth transistor is electrically connected to the fourth node, and a drain of the sixth transistor is electrically connected to the second node.

10. The display driving circuit according to claim 1, wherein the pull-down unit comprises a seventh transistor, an eighth transistor, and a ninth transistor.

11. The display driving circuit according to claim 10, wherein a gate of the seventh transistor, a gate of the eighth transistor, and a gate of the ninth transistor are electrically connected to the second cascade signal input terminal, a source of the seventh transistor is electrically connected to the seventh node, a drain of the seventh transistor is electrically connected to the third node, a source of the eighth transistor and a drain of the ninth transistor are electrically connected to the eighth node, a drain of the eighth transistor is electrically connected to the first node, and a source of the ninth transistor is electrically connected to the sixth node.

12. The display driving circuit according to claim 1, wherein the pull-down maintaining unit comprises a tenth transistor, an eleventh transistor, a twelfth transistor, a thirteenth transistor, and a fourteenth transistor.

13. The display driving circuit according to claim 12, wherein a gate of the tenth transistor, a gate of the eleventh transistor, a gate of the twelfth transistor, a gate of the thirteenth transistor, and a gate of the fourteenth transistor are electrically connected to the ninth node, and a drain of the tenth transistor and a source of the eleventh transistor are electrically connected to the eighth node, a source of the tenth transistor is electrically connected to the sixth node, a drain of the eleventh transistor is electrically connected to the first node, a source of the twelfth transistor and a source of the thirteenth transistors are electrically connected to the seventh node, a drain of the twelfth transistor is electrically connected to the fourth node, and a drain of the thirteenth transistor is electrically connected to the third node, a source of the fourteenth transistor is electrically connected to the first high-voltage signal input terminal, and a drain of the fourteenth transistor is electrically connected to the fifth node.

14. The display driving circuit according to claim 1, wherein the inverter unit comprises a fifteenth transistor, a sixteenth transistor, a seventeenth transistor, and an eighteenth transistor.

15. The display driving circuit according to claim 14, wherein a gate of the fifteenth transistor and a gate of the seventeenth transistor are electrically connected to the first node, a source of the fifteenth transistor and a source of the seventeenth transistor are electrically connected to the sixth node, a drain of the fifteenth transistor and a drain of the sixteenth transistor are electrically connected to the ninth node, a source of the sixteenth transistor, a source of the eighteenth transistor, and a gate of the eighteenth transistor gate are electrically connected to the second high-voltage signal input terminal, and a gate of the sixteenth transistor and a drain of the seventeenth transistor are electrically connected to a drain of the eighteenth transistor.

16. The display driving circuit of claim 1, wherein the first low-voltage signal input terminal, the second low-voltage signal input terminal, and the third low-voltage signal input terminal continuously input low-voltage signals, and the first high-voltage signal input terminal and the second high-voltage signal input terminal continuously input high-voltage signals.

17. The display driving circuit according to claim 1, wherein the first cascade signal input terminal of the driving unit of a first stage is electrically connected to a start signal line, and the start signal line is configured to send a start signal to the first cascade signal input terminal; and the second cascade signal input terminal of the driving unit of the first stage is electrically connected to the cascade signal output terminal of the driving unit of a second stage.

18. The display driving circuit according to claim 17, wherein the first cascade signal input terminal of the driving unit of a nth stage is electrically connected to cascade signal output terminal of the driving unit of a n−1th stage; and the second cascade signal input terminal of the driving unit of a nth stage is electrically connected to the cascade signal output terminal of the driving unit of a n+1th stage, wherein n is an integer greater than or equal to 2.

19. The display driving circuit according to claim 18, wherein the second cascade signal input terminal of the driving unit of a last stage is electrically connected to the first low-voltage signal input of the driving unit of a last stage.

* * * * *